US005853354A

United States Patent [19]

Kubota

[11] Patent Number: 5,853,354

[45] Date of Patent: Dec. 29, 1998

[54] LEG AND ANKLE EXERCISE DEVICE

[76] Inventor: Kenneth Kubota, 9751 Talbert Ave., Fountain Valley, Calif. 92708

[21] Appl. No.: 953,677

[22] Filed: Oct. 17, 1997

[51] Int. Cl.[6] ..... A63B 23/08

[52] U.S. Cl. ..... 482/80; 482/907

[58] Field of Search ..... 422/79, 80, 907; 601/27, 32

[56] References Cited

U.S. PATENT DOCUMENTS

| | | | |
|---|---|---|---|
| 1,546,506 | 7/1925 | Naysmith | 482/80 |
| 1,706,654 | 6/1929 | Christesen . | |
| 2,160,722 | 3/1939 | Cunningham . | |
| 4,039,183 | 8/1977 | Sakurada . | |
| 4,463,947 | 8/1984 | Kloenne . | |
| 4,544,155 | 10/1985 | Wallenbrock et al. . | |
| 4,669,450 | 6/1987 | Lindberg | 482/80 |
| 5,013,037 | 5/1991 | Stermer . | |
| 5,076,576 | 12/1991 | Johnston . | |
| 5,203,754 | 4/1993 | Maclean . | |
| 5,261,865 | 11/1993 | Trainor . | |
| 5,277,680 | 1/1994 | Johnston . | |
| 5,286,242 | 2/1994 | Johnston . | |
| 5,433,684 | 7/1995 | Carillo | 482/80 |
| 5,569,135 | 10/1996 | Chen . | |
| 5,611,770 | 3/1997 | Tesch | 482/80 |

*Primary Examiner*—Lynne A. Reichard
*Attorney, Agent, or Firm*—Dennis W. Beech

[57] ABSTRACT

The leg and ankle exercise device has a foot member rotatable attached to a pair of attachment arms which extend from and are attached to a leg member. The leg member is attached to the back of the lower leg of an exercise user by leg straps. The user's foot rests on the foot member and is positioned and retained by a heel rest and a foot strap. A handle attached to the toe end of the foot rest is then pulled by the user to provide the force against which to rotate and exercise the ankle and the back of the leg including the tendons and muscles, i.e., hamstring muscles, achilles tendon and others, as well as the user's back.

3 Claims, 1 Drawing Sheet

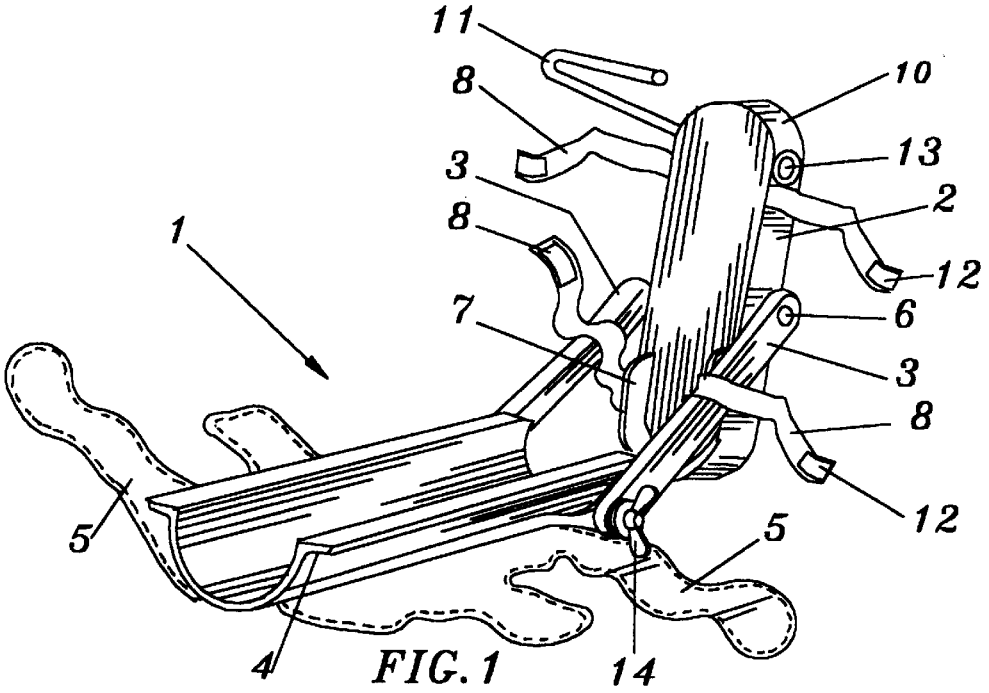
FIG. 1
FIG. 2
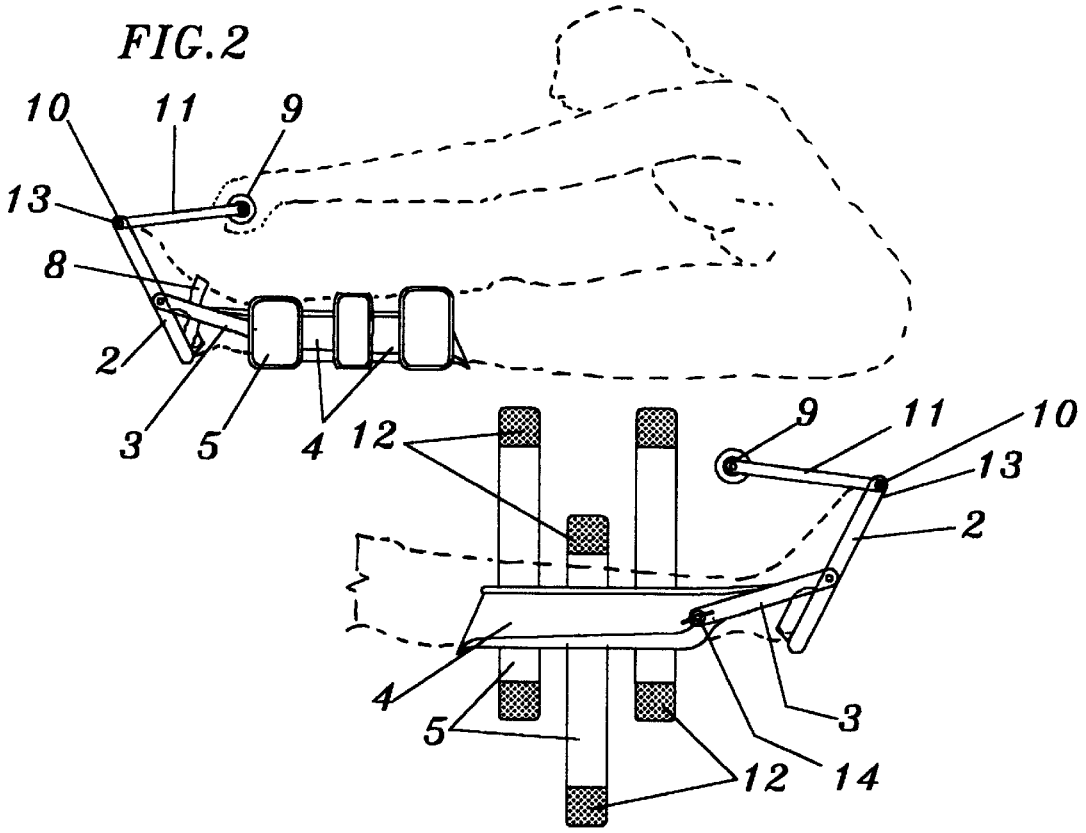
FIG. 3

LEG AND ANKLE EXERCISE DEVICE

BACKGROUND OF THE INVENTION

1. Field of the Invention

This invention relates to devices used to exercise, strengthen and rehabilitate human muscles, tendons and joints. The present invention may be used to exercise and stretch the muscles and tendons associated with the ankle and back of the leg.

2. Description of Related Art

There are currently in use many devices for exercise of the limbs of the human body. A subset of these are designed for exercise of the legs. These include exercise bicycles, machines designed to walk on, step exercise machines and the like. All of these apparatus are large and cumbersome.

In addition there are portable leg and foot exercise devices, such as, embodied in U.S. Pat. Nos. 5,277,680; 5,261,865; and 2,160,722, which provide for some form of pulling on a stirrup or foot device attached to the foot and having cables or straps. However, these devices do not include an ankle, achilles tendon and back of the leg combination exercise means.

The present invention uses a foot platform rotatably mounted to attachment arms of a leg member which is attached to the users lower leg. A handle attached by attachment bars to the toe end of the foot platform is then pulled by the users hand and arm against the strength of the leg and ankle muscles and tendons. This simple portable device thus allows exercise of the ankle and stretching of the muscles and tendons associated with the ankle and back of the leg. This is commonly done by runners and others as this is the area of injury for muscles and tendons if proper stretching and toning is not done.

SUMMARY OF THE INVENTION

One object of the present invention is a device for exercise of the lower leg and ankle of a user. A further object is to allow stretching and exercise of the muscles and tendons in the back of the users leg. Another object is use of the upper body, arms and hands of the user as the force against which to exercise the ankle and leg.

In accordance with the description presented herein, other objectives of this invention will become apparent when the description and drawings are reviewed.

BRIEF DESCRIPTION OF THE DRAWING

FIG. 1 illustrates a perspective view of the leg and ankle exercise device.

FIG. 2 illustrates a side elevation view of the device attached and in use for exercise.

FIG. 3 illustrates a side elevation view of the device with fastening straps.

DESCRIPTION OF THE PREFERRED EMBODIMENT

The leg and ankle exercise device has a foot member rotatably attached to a leg member by means of a pair of attachment arms. The elements are arranged such that the leg member may be fastened to the users leg with the users foot resting on the foot member. The user then exercises by pulling with his hand and arm on a handle attached to the toe end of the foot member.

Referring to FIGS. 1 through 3, the leg and ankle exercise device (1) has a foot member (2) rotatably attached to a pair of attachment arms (3) which are attached to a leg member (4). The leg member (4) may be in the form of a trough, be formed to the general shape of the back of a human leg or be a rectangular board with leg retaining devices (5) such that the leg member (4) may be attached against the user's lower leg.

The attachment arms (3) extend longitudinally from either side of the leg member (4) at an angle such that the pivot point (6) is located under the user's foot at the rotation position for the user's ankle to rotate the foot. The attachment arms (3) may have an adjustable fastener (14) for attachment to the leg member (4) to allow for adjustment of the angle at which the attachment arms (3) are attached to the leg member (4). The foot member (2) has a heel rest (7) against which to rest the user's heel. Foot retaining devices (8) are used to retain the foot on the foot member (2) during exercise.

A handle (9) is attached to the toe end (10) of the foot member (2) by means of attachment bars (11) rotatably mounted in apertures (13). With the leg and ankle exercise device (1) attached to the user's lower leg and foot, the user pulls on the handle (9) to provide the force against which the ankle and back leg muscles and tendons work. Hook and loop (12) attachment means are illustrated with straps as leg retaining devices (5) and foot retaining devices (8) in the Figures; however, other suitable retaining devices, such as, laces, bands and the like may be used.

I claim:

1. A device for exercising the human leg and ankle comprising:

a foot member rotatably attached at a pivot point to a pair of attachment arms which extend longitudinally from either side of a leg member at an angle of between 5 degrees and 70 degrees from the longitudinal axis thereof;

a leg retaining device attached to the leg member and used for attachment of the leg member to the lower leg of a user;

a foot retaining device attached to the foot member for use in positioning and retaining the user's foot; and a handle attached at a toe end of the foot member by means of a pair of attachment bars.

2. The device as in claim 1 wherein the attachment arms angle of extension is approximately 25 degrees.

3. A device for exercising the human leg and ankle comprising:

a foot member rotatably attached at a pivot point to a pair of attachment arms which are attached to a leg member by an adjustable fastener and which extend longitudinally from either side of the leg member;

a leg retaining device attached to the leg member and used for attachment of the leg member to the lower leg of a user;

a foot retaining device attached to the foot member for use in positioning and retaining the user's foot; and a handle attached at a toe end of the foot member by means of a pair of attachment bars.

* * * * *